US011249410B2

(12) United States Patent
Takahashi et al.

(10) Patent No.: US 11,249,410 B2
(45) Date of Patent: Feb. 15, 2022

(54) TONER

(71) Applicant: CANON KABUSHIKI KAISHA, Tokyo (JP)

(72) Inventors: Toru Takahashi, Toride (JP); Daisuke Tsujimoto, Tokyo (JP); Hiroki Watanabe, Matsudo (JP); Yoshihiro Ogawa, Toride (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/707,540

(22) Filed: Dec. 9, 2019

(65) Prior Publication Data

US 2020/0192233 A1 Jun. 18, 2020

(30) Foreign Application Priority Data

Dec. 12, 2018 (JP) ..... JP2018-232102

(51) Int. Cl.
*G03G 9/087* (2006.01)
*G03G 9/097* (2006.01)

(52) U.S. Cl.
CPC ..... *G03G 9/08755* (2013.01); *G03G 9/09758* (2013.01); *G03G 9/09775* (2013.01)

(58) Field of Classification Search
CPC . G03G 9/097; G03G 9/09741; G03G 9/09758
See application file for complete search history.

(56) References Cited

U.S. PATENT DOCUMENTS 3,893,935 A * 7/1975 Jadwin ..... G03G 9/09741 430/108.2
5,437,949 A 8/1995 Kanbayashi et al.
5,607,806 A 5/1997 Kanbayashi et al.
5,635,326 A 6/1997 Kanbayashi et al.
5,670,288 A 9/1997 Okado et al.
5,700,617 A 12/1997 Takiguchi et al.
5,747,209 A 5/1998 Takiguchi et al.
5,750,302 A 5/1998 Ogawa et al.
5,851,714 A 12/1998 Taya et al.
5,858,593 A 1/1999 Tamura et al.
5,912,099 A 6/1999 Kanbayashi et al.
5,922,500 A 7/1999 Iida et al.
5,976,752 A 11/1999 Matsunaga et al.
5,994,018 A 11/1999 Iida et al.
6,013,402 A 1/2000 Kanbayashi et al.
6,022,659 A 2/2000 Kanbayashi et al.
6,060,202 A 5/2000 Ogawa et al.
6,077,635 A 6/2000 Okado et al.
6,238,834 B1 5/2001 Tamura et al.
6,326,114 B1 12/2001 Itakura et al.
6,426,169 B1 7/2002 Onuma et al.
6,485,875 B1 11/2002 Karaki et al.
6,528,222 B2 3/2003 Kohtaki et al.
6,586,147 B2 7/2003 Iida et al.
6,664,016 B2 12/2003 Kanbayashi et al.
6,751,424 B2 6/2004 Komatsu et al.
6,808,852 B2 10/2004 Hotta et al.
6,875,549 B2 4/2005 Yamazaki et al.
6,881,527 B2 4/2005 Moribe et al.
7,115,349 B2 11/2006 Iida et al.
7,147,980 B2 12/2006 Itakura et al.
7,267,919 B2 9/2007 Moribe et al.
7,368,211 B2 5/2008 Hasegawa et al.
7,402,368 B2 7/2008 Ogawa et al.
7,422,832 B2 9/2008 Ogawa et al.
7,455,947 B2 11/2008 Ida et al.
7,470,494 B2 12/2008 Nishiyama et al.
7,544,457 B2 6/2009 Hashimoto et al.
7,582,401 B2 9/2009 Ogawa et al.
7,678,524 B2 3/2010 Hasegawa et al.
7,704,659 B2 4/2010 Ogawa et al.
7,811,734 B2 10/2010 Ogawa et al.
7,816,063 B2 11/2010 Hashimoto et al.
7,939,231 B2 5/2011 Ogawa et al.
(Continued)

FOREIGN PATENT DOCUMENTS

JP 02-073368 * 3/1990 ..... G03G 9/097
JP 4603837 12/2010
JP 2017-223895 12/2017

OTHER PUBLICATIONS

Translation of JP 02-073368.*
Translation of Abstract of JP 02-073368.*

*Primary Examiner* — Peter L Vajda
(74) *Attorney, Agent, or Firm* — Venable LLP

(57) ABSTRACT

A toner having an adequate storage stability and adequately suppressing an ejected paper adhesion, while achieving improving low-temperature fixability, has a toner particle containing a binder resin and a plasticizer, wherein Tg1 is 53° C. or lower and Tg2 is 55° C. or higher, in DSC measurement using the toner as a sample, when the following steps (i) to (iii) are performed: (i): the temperature of the toner is raised for the first time at a rate of temperature increase of 10° C./min, (ii): after the step (i), the temperature of the toner is lowered at a rate of temperature decrease of 10° C./min, (iii): after the step (ii), the temperature of the toner is raised for the second time at a rate of temperature increase of 10° C./min, Tg1 represents a glass transition temperature measured at the step (i), and Tg2 represents a glass transition temperature measured at the step (iii).

8 Claims, No Drawings

(56) References Cited

U.S. PATENT DOCUMENTS

| | | | | |
|---|---|---|---|---|
| 8,084,174 | B2 | 12/2011 | Hasegawa et al. | |
| 8,124,306 | B2 | 2/2012 | Hirata et al. | |
| 8,501,377 | B2 | 8/2013 | Takahashi et al. | |
| 8,512,925 | B2 | 8/2013 | Moribe et al. | |
| 9,097,998 | B2 | 8/2015 | Yamazaki et al. | |
| 9,128,400 | B2 | 9/2015 | Takahashi et al. | |
| 9,158,217 | B2 | 10/2015 | Takahashi et al. | |
| 9,454,094 | B2 | 9/2016 | Tsujimoto et al. | |
| 9,500,975 | B2 | 11/2016 | Sugahara et al. | |
| 9,599,920 | B2 | 3/2017 | Sugahara et al. | |
| 9,606,466 | B2 | 3/2017 | Takahashi et al. | |
| 9,703,216 | B2 | 7/2017 | Tsuchida et al. | |
| 9,778,598 | B2 | 10/2017 | Onozaki et al. | |
| 9,785,070 | B2 | 10/2017 | Sugahara et al. | |
| 9,958,809 | B2 | 5/2018 | Sugahara et al. | |
| 10,007,206 | B2 | 6/2018 | Sugahara et al. | |
| 10,409,188 | B2 | 9/2019 | Sugahara et al. | |
| 10,451,985 | B2 | 10/2019 | Takahashi et al. | |
| 10,551,759 | B2 | 2/2020 | Watanabe et al. | |
| 2002/0055053 | A1 | 5/2002 | Kasuya et al. | |
| 2004/0110076 | A1 | 6/2004 | Yamazaki et al. | |
| 2013/0252167 | A1 | 9/2013 | Moribe et al. | |
| 2013/0309603 | A1 | 11/2013 | Takahashi et al. | |
| 2014/0004460 | A1 | 1/2014 | Yoshiba et al. | |
| 2015/0185648 | A1 * | 7/2015 | Uratani ..... | G03G 9/08782 430/108.3 |
| 2020/0050123 | A1 | 2/2020 | Sugahara et al. | |
| 2020/0050124 | A1 | 2/2020 | Matsuo et al. | |
| 2020/0073265 | A1 | 3/2020 | Tsujimoto et al. | |
| 2020/0073266 | A1 | 3/2020 | Ohtsu et al. | |
| 2020/0103777 | A1 | 4/2020 | Sugahara et al. | |

* cited by examiner

TONER

BACKGROUND OF THE INVENTION

Field of the Invention

The present disclosure relates to a toner for developing an electrostatic charge image which is used in an electrophotographic method, an electrostatic recording method and the like.

Description of the Related Art

In recent years, as image forming apparatuses such as copying machines and printers have become widespread, the image forming apparatus is required to have high speed and adaptability to various media such as thick paper and coated paper, as its performance.

In order to enhance the high speed and the adaptability to various media of the image forming apparatus, a further improvement of low-temperature fixability has been required for the toner, and various studies have been conducted. For example, in Japanese Patent No. 4603837, a technology is disclosed which improves the low-temperature fixability by making an amorphous polyester resin contain a crystalline polyester as a plasticizer.

On the other hand, when the crystalline polyester and the amorphous polyester dissolve in each other, there is a case where the storage stability of the toner becomes aggravated, because the effect of lowering the glass transition temperature (Tg) becomes high. As for a method of improving the storage stability of the toner, such a technology is disclosed, for example, in Japanese Patent Application Laid-Open No. 2017-223895, as to maintain the storage stability by recrystallizing the crystalline polyester by preparing an annealing step, and thereby increasing the Tg of the toner.

On the other hand, copying machines are required to have the adaptability to media including thin paper to thick paper and coated paper. As for a method of adapting to the media, when the thick paper, for example, is used, the heat capacity of the paper becomes high, and accordingly the copying machines have adapted to the case by increasing a temperature of a temperature control at the time of fixing.

SUMMARY OF THE INVENTION

However, in the inventions of Japanese Patent No. 4603837 and Japanese Patent Application Laid-Open No. 2017-223895, it is intended to further improve the low-temperature fixability by using the crystalline polyester, but then, in the toner layer on the paper after fixing, the crystalline polyester and the amorphous polyester are in a state of being dissolved in each other, and accordingly the Tg is lowered.

Furthermore, when the thick paper is used, the fixing temperature needs to be set high, and accordingly a high amount of heat is given to the paper. When the paper is stacked on a copy receiving tray, the radiation of the heat from the paper does not progress, and the temperature of the paper bundle is kept high. A phenomenon that the temperature of the paper bundle is kept high occurs more notably at the time of double-sided printing. When the Tg of the toner layer is low and the temperature of the paper bundle is kept high, sometimes adhesion occurred between the toner layers after paper ejection (hereinafter referred to as ejected paper adhesion).

In order to satisfy both of further improvement in the low-temperature fixability and suppression of the ejected paper adhesion, while adapting to the thick paper, further improvement of the toner is indispensable.

The present disclosure has been made in order to solve the above problems, and an object of the present disclosure is to provide a toner that adequately suppresses the ejected paper adhesion while further improving the low-temperature fixability.

The present disclosure relates to a toner having a toner particle including a binder resin and a plasticizer, wherein Tg1 is 53° C. or lower and Tg2 is 55° C. or higher, wherein in DSC measurement using the toner as a sample, when the following steps (i) to (iii) are performed: step (i): the temperature of the toner is raised for the first time at a rate of temperature increase of 10° C./min, step (ii): after the step (i), the temperature of the toner is lowered at a rate of temperature decrease of 10° C./min, step (iii): after the step (ii), the temperature of the toner is raised for the second time at a rate of temperature increase of 10° C./min, Tg1 represents a glass transition temperature measured at the step (i), and Tg2 represents a glass transition temperature measured at the step (iii).

According to the present disclosure, a toner can be provided wherein the ejected paper adhesion is adequately suppressed while further improvement in the low-temperature fixability is achieved.

Further features of the present invention will become apparent from the following description of exemplary embodiments.

DESCRIPTION OF THE EMBODIMENTS

Preferred embodiments of the present disclosure will now be described in detail.

A toner of the present disclosure is a toner having a toner particle including a binder resin and a plasticizer, wherein Tg1 is 53° C. or lower and Tg2 is 55° C. or higher. Here, in DSC measurement using the toner as a sample, when the following steps (i) to (iii) are performed: step (i): the temperature of the toner is raised for the first time at a rate of temperature increase of 10° C./min, step (ii): after the step (i), the temperature of the toner is lowered at a rate of temperature decrease of 10° C./min, step (iii): after the step (ii), the temperature of the toner is raised for the second time at a rate of temperature increase of 10° C./min, Tg1 represents a glass transition temperature measured at the step (i), and Tg2 represents a glass transition temperature measured at the step (iii). Each measuring method will be described later.

The above toner adequately suppresses the ejected paper adhesion while achieving further improvement in the low-temperature fixability.

The reason why an excellent effect that has not been obtained in the past can be obtained by the above composition is considered as follows.

Tg1 represents the glass transition temperature of the toner when the temperature of the toner is raised from a powder state. In other words, Tg1 represents the Tg of the toner at which the toner melts at the time of fixing from the time before fixing. On the other hand, Tg2 represents a glass transition temperature at the time when the toner which has melted by the first time of temperature raising is cooled and then the temperature is raised again. In other words, Tg2 represents the Tg of the toner layer on the paper, after having been fixed and melted.

The present inventors have considered that in order to improve the low-temperature fixability, it is necessary to plasticize the toner at the time of fixing and thereby lower the Tg, but on the other hand, in order to suppress the ejected paper adhesion, it is necessary to enhance the Tg of the toner layer after fixing. However, when the conventional plasticizer and the binder resin dissolve in each other, the Tg is lowered and the low-temperature fixability is improved, but the Tg of the toner layer after fixing also lowers, and it becomes difficult to suppress the ejected paper adhesion; and accordingly it has been difficult to achieve both of the above performances.

The present inventors have made an extensive investigation on the above problems, and as a result, have found a toner which adequately suppresses the ejected paper adhesion while achieving further improvement in the low-temperature fixability, by designing a toner having thermal characteristics different from those of conventional toners.

Specifically, the present inventors have found that when the Tg1 is 53° C. or lower, the toner at the time of fixing is plasticized, and accordingly the low-temperature fixability becomes adequate; and when the Tg2 is 55° C. or higher, the Tg of the toner layer after melting is high, and accordingly the ejected paper adhesion is adequately suppressed. By the toner of the present disclosure being used, further improvement in the low-temperature fixability and suppression of the ejected paper adhesion can have been achieved which have been difficult for the conventional toners to achieve.

The toner of the present disclosure is characterized in that the Tg2 after melting is higher than the Tg1. The Tg of the toner can be controlled, for example, by the control of the compatibility and phase separation between the binder resin and the plasticizer. In the toner before fixing, the Tg can be controlled to be low by a phenomenon that the binder resin and the plasticizer dissolve in each other, and on the other hand, in the toner after melting, the Tg which has been lowered rises due to a phenomenon that the binder resin and the plasticizer cause the phase separation.

The Tg1 becomes a value lower than the Tg of the binder resin by the phenomenon that the binder resin and the plasticizer dissolve in each other. The Tg1 is 53° C. or lower, and thereby the low-temperature fixability becomes adequate. The lower limit is not set in particular, but it is preferable for Tg1 to be 40° C. or higher from the viewpoint of the storage stability of the toner, and is more preferable to be 45° C. or higher. The Tg1 can be controlled by the Tg of the binder resin and the amount of plasticizer to be added.

As for the Tg2, a value higher than Tg1 can be obtained by the phenomenon that the binder resin and the plasticizer cause the phase separation. The Tg2 is 55° C. or higher, thereby the ejected paper adhesion is adequately suppressed; and Tg2 is more preferably 57° C. or higher. The upper limit is not set in particular, but is preferably 70° C. or lower, and more preferably is 65° C. or lower, from the viewpoint of controlling Tg1.

It is preferable for a melting point of the plasticizer to be 60° C. or higher and 150° C. or lower, and is more preferable to be 60° C. or higher and 140° C. or lower. By the plasticizer being used which has the above melting point, the compatibility with the binder resin and the phase separation after melting become adequate, and Tg1 and Tg2 become easily controlled.

The types of binder resin and plasticizer are not limited in particular as long as the toner satisfies the above Tg1 and Tg2, but it is preferable that the binder resin is a polyester resin, and the plasticizer contains an imidazolium salt or an ammonium salt, because the Tg is easily controlled.

The polyester resin will be described below in detail.

Note that, the following components can be used alone or in combination with one or more other components, depending on the type or the application.

Examples of polyester resins can include condensation polymers of the following acid components and the following alcohol components.

Divalent acid components include the following dicarboxylic acids or derivatives thereof:

benzene dicarboxylic acids such as phthalic acid, terephthalic acid, isophthalic acid, phthalic anhydride, anhydrides thereof and lower alkyl esters thereof; alkyl dicarboxylic acids such as succinic acid, adipic acid, sebacic acid, azelaic acid, anhydrides thereof and lower alkyl esters thereof; alkenyl succinic acids or alkyl succinic acids having 1 to 50 carbon atoms by an average value, anhydrides thereof and lower alkyl esters thereof; and unsaturated dicarboxylic acids such as fumaric acid, maleic acid, citraconic acid and itaconic acid, anhydrides thereof and lower alkyl esters thereof.

Dihydric alcohol components include the following:

ethylene glycol, polyethylene glycol, 1,2-propanediol, 1,3-propanediol, 1,3-butanediol, 1,4-butanediol, 2,3-butanediol, diethylene glycol, triethylene glycol, 1,5-pentanediol, 1,6-hexanediol, neopentyl glycol, 2-methyl-1,3-propanediol, 2-ethyl-1,3-hexanediol, 1,4-cyclohexanedimethanol (CHDM), hydrogenated bisphenol A, bisphenol represented by formula (I) and derivatives thereof, and diols represented by formula (II).

(I)

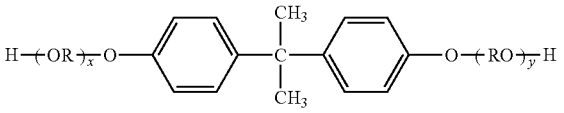

(In the formula, R is an ethylene group or a propylene group, x and y are each an integer of 0 or more, and the average value of x+y is 0 or more and 10 or less.)

(II)

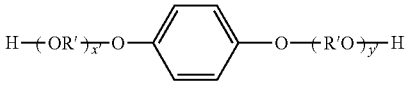

(In the formula, R' is an ethylene group or a propylene group, x' and y' are each an integer of 0 or more, and the average value of x+y is 0 or more and 10 or less.)

The constituent component of the polyester resin may contain a trivalent or higher carboxylic acid compound and a trihydric or higher alcohol compound as a constituent component, in addition to the above divalent carboxylic acid compound and dihydric alcohol compound.

The trivalent or higher carboxylic acid compound is not limited in particular, and includes trimellitic acid, trimellitic anhydride, and pyromellitic acid.

In addition, the trihydric or higher alcohol compound includes trimethylolpropane, pentaerythritol and glycerin.

Furthermore, the above constituent component of the polyester resin may contain a monovalent carboxylic acid compound and a monohydric alcohol compound as constituent components, in addition to the above compounds.

Specifically, the monovalent carboxylic acid compound includes palmitic acid, stearic acid, arachidic acid, behenic acid, cerotic acid, heptacosanoic acid, montanic acid, melissic acid, laccelic acid, tetracontanic acid, and pentacontanic acid.

On the other hand, the monohydric alcohol compound includes behenyl alcohol, ceryl alcohol, melissyl alcohol and tetracontanol.

A method for producing the polyester resin is not limited in particular, and a heretofore known method can be used.

The method includes, for example, a method of polymerizing the above divalent carboxylic acid compound and the dihydric alcohol compound, through an esterification reaction or a transesterification reaction, and a condensation reaction.

The polymerization temperature is not limited in particular, but is preferably in a range of 180° C. or higher and 290° C. or lower. For the polymerization of the polyester structure, a polymerization catalyst can be used, for example, such as a titanium-based catalyst, a tin-based catalyst, zinc acetate, antimony trioxide and germanium dioxide.

The binder resin may contain another resin in addition to the polyester resin. The other binder resins include the following:

a styrene resin, a styrene-based copolymer resin, a polyol resin, a polyvinyl chloride resin, a phenol resin, a natural modified phenolic resin, a natural resin modified maleic acid resin, an acrylic resin, a methacrylic resin, polyvinyl acetate, a silicone resin, a polyurethane resin, a polyamide resin, a furan resin, an epoxy resin, a xylene resin, polyvinyl butyral, a terpene resin, a coumarone-indene resin and a petroleum-based resin.

It is preferable that the toner contains 3% by mass to 15% by mass of the plasticizer in order to control the Tg1 and the Tg2 in a preferable range.

It is preferable that the plasticizer is an imidazolium salt represented by the following general formula (1).

general formula (1)

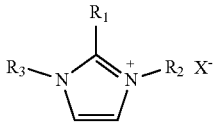

(In the above general formula (1), $R_1$ represents hydrogen or a methyl group, $R_2$ and $R_3$ each independently represent an alkyl group having 1 to 4 carbon atoms or a benzyl group, and $X^-$ represents a counter anion.)

In addition, it is preferable that the above plasticizer is an ammonium salt represented by the following general formula (2).

general formula (2)

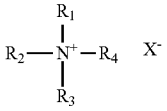

(In the above general formula (2), $R_1$ to $R_4$ each independently represent an alkyl group having 4 to 6 carbon atoms, and $X^-$ represents a counter anion.)

By the plasticizer being used which is represented by the above general formula (1) or the general formula (2), a plasticizing effect on the polyester resin and the phase separation at the time of melting become adequate, and the Tg1 and the Tg2 become easily controlled.

The imidazolium salt represented by the above general formula (1) specifically includes the following compounds:

1,2,3-trimethylimidazolium methyl sulfate, 1-benzyl-3-methylimidazolium chloride, 1-benzyl-3-methylimidazolium hexafluorophosphate, 1-benzyl-3-methylimidazolium tetrafluoroborate, 1-butyl-2,3-dimethylimidazolium chloride, 1-butyl-3-methylimidazolium bromide, 1-ethyl-3-methylimidazolium chloride, and 1-ethyl-3-methylimidazolium hexafluorophosphate. Among the imidazolium salts, the 1,2,3-trimethylimidazolium methylsulfate is preferable for controlling the Tg1 and the Tg2 of the polyester resin.

The ammonium salt represented by the above general formula (2) specifically includes the following compounds:

tetrabutylammonium methanesulfonate, tetrabutylammonium benzoate, tetrahexylammonium tetrafluoroborate, tetrapentylammonium bromide, tetrabutylammonium bromide, tetraheptylammonium bromide, and tetrahexylammonium bromide. Among the ammonium salts, the tetrabutylammonium methanesulfonate is preferable for controlling the Tg1 and the Tg2 of the polyester resin.

The above toner particle may contain a mold release agent (wax) in order to give mold release characteristics.

The above wax includes the following compounds:

aliphatic hydrocarbon-based waxes such as low molecular weight polyethylene, low molecular weight polypropylene, an olefin copolymer, microcrystalline wax, paraffin wax, Fischer-Tropsch wax; oxidized waxes of aliphatic hydrocarbon-based waxes, such as oxidized polyethylene wax; waxes containing fatty acid esters as a main component, such as carnauba wax, behenyl behenate and montanate wax; and such a compound as deoxidized carnauba wax, which is obtained by deoxidizing a part or all of a fatty acid ester.

Among the waxes, the aliphatic hydrocarbon-based wax is preferable. The aliphatic hydrocarbon-based wax includes, for example, hydrocarbons of low molecular weight, which are obtained by radically polymerizing alkylenes under high pressure, or polymerizing alkylenes with Ziegler catalyst or metallocene catalyst under low pressure; Fischer-Tropsch wax which is synthesized from coal or natural gas; olefin polymers which are obtained by thermally decomposing olefin polymers of high molecular weight; and synthetic hydrocarbon waxes that are obtained from a distillation residue of a hydrocarbon, which is obtained from a synthesis gas containing carbon monoxide and hydrogen by an Arge method, or synthetic hydrocarbon waxes that are obtained by hydrogenating the above synthetic hydrocarbon waxes.

Furthermore, waxes are more preferable which are obtained by fractionating hydrocarbon wax by using a press sweating process, a solvent method and a vacuum distillation or a fractional crystallization method. In particular, a wax synthesized by a method that does not rely on polymerization of an alkylene is preferable also from its molecular weight distribution.

As for the timing of addition of the wax, the wax may be added at the time of the production of the toner, or may be added at the time of the production of the binder resin. Moreover, these waxes may be used alone or used in combination with one or more other waxes.

It is preferable that the content of the wax is 1 part by mass or more and 20 parts by mass or less with respect to 100 parts by mass of the binder resin.

The toner can employ any form of a magnetic one-component developer, a non-magnetic one-component developer and a non-magnetic two-component developer.

In the case of the magnetic one-component developer, a magnetic material is preferably used as a coloring agent. The magnetic materials include magnetic iron oxides such as magnetite, maghemite and ferrite, and magnetic iron oxides containing other metal oxides; metals such as Fe, Co and Ni, or alloys of the above metals with metals such as Al, Co, Cu, Pb, Mg, Ni, Sn, Zn, Sb, Be, Bi, Cd, Ca, Mn, Se, Ti, W and V; and mixtures thereof.

It is preferable that the content of the magnetic material is 30 parts by mass or more and 100 parts by mass or less with respect to 100 parts by mass of the binder resin.

In the case of the non-magnetic one-component developer and the non-magnetic two-component developer, the coloring agents include the following materials.

Black pigments include carbon black such as furnace black, channel black, acetylene black, thermal black and lamp black. In addition, a magnetic material such as magnetite or ferrite can be used.

Examples of coloring agents of a yellow color include the following pigments and dyes.

The pigments include C. I. Pigment yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, 191, and C. I. Vat yellow 1, 3, and 20.

The dyes include C. I. Solvent yellow 19, 44, 77, 79, 81, 82, 93, 98, 103, 104, 112 and 162.

The pigments and dyes can be used each alone or used in combination with other one or more types.

Examples of coloring agents of a cyan color include the following pigments and dyes.

The pigments include C. I. Pigment Blue 1, 7, 15, 15;1, 15;2, 15;3, 15;4, 16, 17, 60, 62 and 66, C. I. Vat Blue 6, and C. I. Acid Blue 45.

The dyes include C. I. Solvent Blue 25, 36, 60, 70, 93 and 95.

The pigments and dyes can be used each alone or used in combination with other one or more types.

Examples of coloring agents of a magenta color include the following pigments and dyes.

The pigments include C. I. Pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48;2, 48;3, 48;4, 49, 50, 51, 52, 53, 54, 55, 57, 57;1, 58, 60, 63, 64, 68, 81, 81;1, 83, 87, 88, 89, 90, 112, 114, 122, 123, 144, 146, 150, 163, 166, 169, 177, 184, 185, 202, 206, 207, 209, 220, 221, 238, 254, C. I. Pigment violet 19, and C. I. Vat red 1, 2, 10, 13, 15, 23, 29 and 35.

The dyes include: oil-soluble dyes such as C. I. Solvent Red 1, 3, 8, 23, 24, 25, 27, 30, 49, 52, 58, 63, 81, 82, 83, 84, 100, 109, 111, 121 and 122, C. I. Disperse red 9, C. I. Solvent Violet 8, 13, 14, 21 and 27, and C. I. Disperse Violet 1; and basic dyes such as C. I. Basic Red 1, 2, 9, 12, 13, 14, 15, 17, 18, 22, 23, 24, 27, 29, 32, 34, 35, 36, 37, 38, 39 and 40, and C. I. Basic violet 1, 3, 7, 10, 14, 15, 21, 25, 26, 27 and 28.

The pigments and dyes can be used each alone or used in combination with other one or more types.

It is preferable that the content of the coloring agent is 1 part by mass or more and 20 parts by mass or less with respect to 100 parts by mass of the binder resin.

The toner may contain a charge control agent. The charge control agent can employ a known charge control agent.

The charge control agent includes an azo-based iron compound, an azo-based chromium compound, an azo-based manganese compound, an azo-based cobalt compound, an azo-based zirconium compound, a chromium compound of a carboxylic acid derivative, a zinc compound of a carboxylic acid derivative, an aluminum compound of a carboxylic acid derivative, and a zirconium compound of a carboxylic acid derivative.

It is preferable that the carboxylic acid derivative is an aromatic hydroxycarboxylic acid. In addition, the charge control resin can also be used. These charge control agents may be used alone or used in combination with other one or more charge control agents. It is preferable that the contents of the charge control agent and the charge control resin is 0.1 parts by mass or more and 10 parts by mass or less with respect to 100 parts by mass of the binder resin.

The toner may contain an external additive in order to improve performances such as charging stability, developability, fluidity and durability.

The external additives include, for example, a charge assisting agent, a conductivity imparting agent, a fluidity imparting agent, an anti-caking agent, a mold release agent at the time of fixing by a heat roller, a lubricant, and a resinous fine particle and an inorganic fine particle which act as a polishing agent and the like. The lubricants include a fine particle of polyfluoroethylene, a fine particle of zinc stearate, and a fine particle of polyvinylidene fluoride. The polishing agents include a fine particle of cerium oxide, a fine particle of silicon carbide, and a fine particle of strontium titanate.

Among the external additives, it is preferable to externally add a silica fine particle to the toner particle.

As for a specific surface area of the silica fine particle by the BET method by nitrogen adsorption, it is preferable to be 30 $m^2/g$ or larger and 500 $m^2/g$ or smaller, and is more preferable to be 50 $m^2/g$ or larger and 400 $m^2/g$ or smaller. In addition, it is preferable for the content of the silica fine particle to be 0.01 parts by mass or more and 8.0 parts by mass or less, and is more preferable to be 0.10 parts by mass or more and 5.0 parts by mass or less with respect to 100 parts by mass of the toner particle.

The above silica fine particle may be treated with unmodified silicone varnish, various modified silicone varnishes, unmodified silicone oil, various modified silicone oils, a silane coupling agent, a silane compound having a functional group, or a treatment agent such as other organosilicon compounds, as needed, for the purpose of hydrophobizing itself or controlling its frictional charging properties.

As described above, the toner may be mixed with a carrier and be used as a two-component developer.

As the carrier, a normal carrier such as ferrite and magnetite or a resin-coated carrier can be used. In addition, a binder type carrier core can also be used in which a magnetic material is dispersed in a resin.

The resin-coated carrier includes a carrier core particle and a coating material that is a resin with which the surface of the carrier core particle is coated. The resins to be used for the coating material include styrene-acrylic resins such as styrene-acrylic ester copolymers and styrene-methacrylic ester copolymers; acrylic resins such as acrylic ester copolymers and methacrylic ester copolymers; fluorine-containing resins such as polytetrafluoroethylene, a monochlorotrifluoroethylene polymer, and polyvinylidene fluoride; silicone resins; polyester resins; polyamide resins; polyvinyl butyral; and amino acrylate resins. Other resins include ionomer resins and a polyphenylene sulfide resin. The resins can be used alone, or a plurality of the resins can be used in combination.

A method for producing the toner is not limited in particular, and can be produced by a known method. Examples thereof include a pulverization method, an emulsion aggregation method, a suspension polymerization method, and a dissolution suspension method.

The toner particle to be produced by the pulverization method is produced, for example, in the following way. The binder resin, the plasticizer, and other additives as required are mixed thoroughly by a mixing machine such as a Henschel mixer or a ball mill. The mixture is melted and kneaded with the use of a thermal kneading machine such as a twin-screw kneading extruder, a heating roll, a kneader and an extruder. At this time, the wax, a magnetic iron oxide particle, and a metal-containing compound can be added. The melt-kneaded product is cooled and solidified, and then is pulverized and classified; and the toner particle is obtained. At this time, an average circularity of the toner particles can be controlled by adjusting an exhaust temperature at the time of fine pulverization. Furthermore, if necessary, the toner particle and the external additive can be mixed by a mixing machine such as a Henschel mixer, and the toner can be obtained.

The mixing machines include the following machines: Henschel mixer (manufactured by Nippon Coke & Engineering Co., Ltd.); Super mixer (manufactured by Kawata Co., Ltd.); Ribocone (manufactured by Okawara MFG. Co., Ltd.); Nauta Mixer, Turbulizer and Cyclomix (manufactured by Hosokawa Micron Corporation); Spiral pin mixer (manufactured by Pacific Machinery & Engineering Co., Ltd.); and Loedige Mixer (manufactured by Matsubo Corporation).

The kneading machines include the following machines: KRC kneader (manufactured by Kurimoto Ltd.); Buss co-kneader (manufactured by Buss A.G.); TEM type extruder (manufactured by Toshiba Machine Co., Ltd.); TEX twin-screw kneader (manufactured by The Japan Steel Works, Ltd.); PCM kneader (manufactured by Ikegai Corp.); Triple roll mill, mixing roll mill and kneader (manufactured by Inoue Mfg. Inc.); Kneedex (manufactured by Nippon Coke & Engineering Co., Ltd.); MS type pressure kneader, Kneader ruder (manufactured by Moriyama manufacturing); and Banbury mixer (manufactured by Kobe Steel Ltd.).

The pulverizers include the following machines: Counter jet mill, micron jet, and Inomizer (manufactured by Hosokawa Micron Corporation); IDS type mill, PJM jet pulverizer (manufactured by Nippon Pneumatic Mfg. Co., Ltd.); Cross jet mill (manufactured by Kurimoto Ltd.); Ulmax (manufactured by Nisso Engineering Co., Ltd.); SK Jet-O-Mill (manufactured by Seishin Enterprise Co., Ltd.); Kryptron (manufactured by Kawasaki Heavy Industries Ltd.); Turbo mill (manufactured by Freund-Turbo Corporation); and Super rotor (manufactured by Nisshin Engineering Inc.).

The classifiers include the following machines:

Classiel, Micron Classifier and Spedic Classifier (manufactured by Seishin Enterprise Co., Ltd.); Turbo classifier (manufactured by Nissin Engineering Inc.); Micron separator, Turboplex (ATP), TSP Separator and TTSP Separator (manufactured by Hosokawa Micron Corporation); Elbow Jet (manufactured by Nittetsu Mining Co., Ltd.), and dispersion separator (manufactured by Nippon Pneumatic Mfg. Co., Ltd.); and YM micro cut (manufactured by Yasukawa Shoji Co., Ltd.).

Sieving apparatuses to be used for sieving coarse particles include the following apparatuses:

Ultrasonic (manufactured by Koei Sangyo Co., Ltd.); Resona sieve, Gyro-shifter (Tokuju Corporation); Vibrasonic System (manufactured by Dalton Corporation); Soniclean (manufactured by ShintoKogyo, Ltd.); Turbo screener (manufactured by Freund-Turbo Corporation); Micro shifter (manufactured by Makino Sangyo Co., Ltd.); and circular vibrating sieve.

Next, a method for measuring Tg according to the present disclosure will be described.

The Tg of the binder resin and the Tg1 and the Tg2 of the toner are measured with the use of a differential scanning calorimeter (DSC) "MDSC-2920" (manufactured by TA Instruments) under normal temperature and normal humidity, according to ASTM D3418-82.

As a measurement sample, approximately 3 mg of the toner which has been accurately weighed is placed in an aluminum pan, and an empty aluminum pan is used as a reference.

A range of a measurement temperature is set at 30° C. or higher and 200° C. or lower, and the temperature is raised from 30° C. to 200° C. at a rate of temperature increase of 10° C./min. In a DSC curve which is obtained in the first temperature raising process, an intersection point of a line between the respective intermediate points of base lines before and after the change of the specific heat with a differential heat curve is defined as the Tg1 of the toner.

After the temperature has been raised to 200° C., the temperature is lowered from 200° C. to 30° C. at a rate of temperature decrease of 10° C./min, and the temperature is raised again from 30° C. to 200° C. at a rate of temperature increase of 10° C./min.

In a DSC curve which is obtained in the second temperature raising process, an intersection point of a line between the respective intermediate points of base lines before and after the change of the specific heat with a differential heat curve is defined as the Tg2 of the toner.

In addition, as for the Tg of the binder resin, the measurement sample is changed to the binder resin, and similar measurement is performed; and the Tg which is obtained in the second temperature raising process is defined as the Tg of the binder resin.

EXAMPLES

The present disclosure will be specifically described below with reference to examples, but the present disclosure is not limited to these examples. Note that all the parts and % in Examples and Comparative Examples are based on mass, unless there is particular notice.

<Production Example of Binder Resin 1>

| | |
|---|---|
| Propylene oxide adduct of bisphenol A (Average number of added moles: 2.2 mol) | 30 mol % |
| Ethylene oxide adduct of bisphenol A (Average number of added moles: 2.2 mol) | 20 mol % |
| Terephthalic acid | 42 mol % |
| Trimellitic anhydride | 8 mol % |

The above monomers and dibutyltin oxide in an amount of 0.03 parts were added to 100 parts in total of the acid components, the mixture was subjected to a reaction while being stirred at 220° C. for 6 hours under a nitrogen stream, and a binder resin 1 was obtained. A glass transition temperature (Tg) of the obtained binder resin 1 was 60° C.

<Production Examples of Binder Resins 2 to 4>

Binder resins 2 to 4 were obtained according to the Production Example of the binder resin 1, except that the Tg of the binder resin was changed as shown in Table 1.

TABLE 1

| Binder resin No. | Tg (° C.) |
|---|---|
| 1 | 60 |
| 2 | 65 |
| 3 | 57 |
| 4 | 55 |

<Production Example of Binder Resin 5>

| | |
|---|---|
| Styrene | 80 parts |
| /n-Butyl acrylate | 20 parts |
| /2,2'-Azobis(2,4-dimethylvaleronitrile) | 0.2 parts |

The above raw materials were added dropwise into 200 parts of heated xylene over 4 hours. Furthermore, the polymerization was completed under reflux of xylene, and the solvent was distilled off under reduced pressure. Thus obtained resin is determined as a binder resin 5. A glass transition temperature (Tg) of the obtained binder resin 5 was 55° C.

<Production Example of Crystalline Polyester 1>

Into a reaction vessel equipped with a nitrogen introduction tube, a dehydration tube, a stirrer and a thermocouple, 100.0 mol parts of 1,10-decanedicarboxylic acid was charged as a carboxylic acid monomer, and 100.0 mol parts of 1,9-nonanediol was charged as an alcohol monomer. The temperature was raised to 140° C. while the mixture was stirred, and the mixture was heated to 140° C. under a nitrogen atmosphere, and was subjected to a reaction for 8 hours under normal pressure while water was distilled off. Subsequently, 0.57 parts of tin dioctylate were added, and then the mixture was subjected to a reaction while the temperature was raised to 200° C. at 10° C./hour. Furthermore, the mixture was subjected to the reaction for 2 hours after having reached 200° C., the pressure in the inside of the reaction tank was reduced to 5 kPa or less, and the mixture was subjected to the reaction at 200° C. while the molecular weight was checked, and a crystalline polyester 1 was obtained. A melting point of the crystalline polyester 1 was 75° C.

Example 1

(Production Example of toner 1)

| | |
|---|---|
| Binder resin 1 | 81 parts |
| 1,2,3-Trimethylimidazolium methylsulfate (1,2,3-Trimethylimidazolium methylsulfate) (plasticizer; melting point of 113° C.) | 9 parts |
| Normal paraffin wax (melting point: 78° C.) | 6 parts |
| C.I. Pigment Blue 15:3 | 4 parts |

The above materials were premixed by a Henschel mixer, and then the mixture was melted and kneaded at 160° C. by a twin-screw kneading extruder.

The obtained kneaded product was cooled, was coarsely pulverized by a hammer mill, and then was finely pulverized by a turbo mill.

The obtained finely pulverized product was classified with the use of a multi-division classifier which used the Coanda effect, and toner particles were obtained which were negatively triboelectrically charged and had a weight average particle size (D4) of 6.0 μm.

To 100 parts of the toner particles, 3.5 parts of fine particles of hydrophobized silica (of which specific surface area by nitrogen adsorption measured by BET method was 140 $m^2/g$) and 0.5 parts of fine particles of titanium oxide (rutile type, and of which specific surface area by nitrogen adsorption measured by BET method was 70 $m^2/g$) were externally added and mixed, then the mixture was sieved by a mesh having a mesh opening of 150 μm, and a toner 1 was obtained. A Tg1 of the toner 1 was 49° C. and a Tg2 thereof was 60° C.

(Production Example of Magnetic Core Particle)

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 part |

Ferrite of a raw material was weighed so that the above materials became the above composition ratios.

After that, the materials were pulverized and mixed for 5 hours in a dry vibration mill which used stainless steel beads having a diameter of ⅛ inches. The obtained pulverized product was formed into a pellet of approximately 1 mm square with the use of a roller compactor.

Coarse powders in the pellets were removed by a vibrating sieve having a mesh opening of 3 mm, subsequently fine powders were removed by a vibrating sieve having a mesh opening of 0.5 mm, then the resultant pellets were fired at a temperature of 1000° C. for 4 hours under a nitrogen atmosphere (oxygen concentration of 0.01% by volume), with the use of a burner type firing furnace, and calcined ferrite was produced. A composition of the obtained calcined ferrite was as follows:

$$(MnO)_a(MgO)_b(SrO)_c(Fe_2O_3)_d$$

wherein a=0.257, b=0.117, c=0.007 and d=0.393.

The calcined ferrite was pulverized into approximately 0.3 mm by a crusher, 30 parts of water was added to 100 parts of the calcined ferrite, and the resultant ferrite was pulverized for 1 hour by a wet ball mill which used zirconia beads having a diameter of ⅛ inches. Furthermore, the obtained slurry was pulverized for 4 hours by a wet ball mill which used alumina beads having a diameter of 1/16 inches, and a ferrite slurry (finely pulverized product of calcined ferrite) was obtained.

To the ferrite slurry, 1.0 part of ammonium polycarboxylate with respect to 100 parts of calcined ferrite was added as a dispersion agent, and 2.0 parts of polyvinyl alcohol was added as a binder; and the resultant mixture was granulated into spherical particles by a spray dryer (manufacturer: Okawara Kakohki Co. Ltd.). After the particle size of the obtained particles was adjusted, the resultant particles were heated at 650° C. for 2 hours with the use of a rotary kiln, and organic components in the dispersion agent and in the binder were removed.

In order to control the firing atmosphere, the temperature of the resultant particles was raised from room temperature to 1300° C. under a nitrogen atmosphere (oxygen concentration: 1.00 vol %) in an electric furnace in 2 hours, and then the resultant particles were fired at a temperature of 1150° C. for 4 hours. After that, the temperature was lowered to 60° C. over 4 hours, the nitrogen atmosphere was returned to the atmosphere, and the particles were taken out at a temperature of 40° C. or lower.

After the aggregated particles were cracked, products with low-magnetic force were cut out by magnetic separation, the coarse particles were removed by sieving with a sieve having a mesh opening of 250 μm, and magnetic core particles were obtained of which the 50% particle size (D50) based on volume distribution was 37.0 μm.

(Production Example of Coating Resin)

| | |
|---|---|
| Cyclohexyl methacrylate monomer | 26.8% |
| Methyl methacrylate monomer | 0.2% |
| Methyl methacrylate macromonomer | 8.4% |

(macromonomer having methacryloyl group at one end and weight average molecular weight of 5000)

| | |
|---|---|
| Toluene | 31.3% |
| Methyl ethyl ketone | 31.3% |
| Azobisisobutyronitrile | 2.0% |

Among the above described materials, the cyclohexyl methacrylate monomer, the methyl methacrylate monomer, the methyl methacrylate macromonomer, the toluene and the methyl ethyl ketone were charged into a four-necked separable flask equipped with a reflux condenser, a thermometer, a nitrogen introduction tube and a stirrer. Nitrogen gas was introduced into the separable flask to make the inside of the flask a sufficient nitrogen atmosphere, then the flask was heated to 80° C., azobisisobutyronitrile was added thereto, the mixture was refluxed for 5 hours, and the materials were polymerized.

Hexane was injected into the obtained reaction product to precipitate and deposit a copolymer.

The obtained precipitate was filtered off and was dried in vacuum, and a resin was obtained.

The resin in an amount of 30 parts was dissolved in a mixed solvent of 40 parts of toluene and 30 parts of methyl ethyl ketone, and a resin solution (solid content concentration of 30%) was obtained.

(Preparation of Coating Resin Solution)

| | |
|---|---|
| Resin solution (solid content concentration of 30%) | 33.3% |
| Toluene | 66.4% |
| Carbon black (Regal 330; produced by Cabot Corporation) (number average particle size of primary particles: 25 nm, specific surface area by nitrogen adsorption: 94 $m^2/g$, and DBP oil absorption: 75 ml/100 g) | 0.3% |

The above materials were charged into a paint shaker, and the solid was dispersed for 1 hour with the use of zirconia beads having a diameter of 0.5 mm. The obtained dispersion liquid was filtered through a 5.0 μm membrane filter, and a coating resin solution was obtained.

(Production Example of Magnetic Carrier)

The above coating resin solution and magnetic core particles were charged into a vacuum degassing type kneader which was kept at room temperature (amount of charged coating resin solution was 2.5 parts in terms of resin component, with respect to 100 parts of magnetic core particles).

After having been charged, the materials were stirred for 15 minutes at a rotation speed of 30 rpm. After a certain amount (80%) or more of the solvent was volatilized, the temperature of the resultant mixture was raised to 80° C. while being mixed under reduced pressure, toluene was distilled off over 2 hours, and then the mixture was cooled.

A product with a low-magnetic force in the obtained magnetic carrier was separated by magnetic separation, the rest was passed through a sieve having an opening of 70 μm, and then was classified by an air classifier; and magnetic carriers were obtained of which the 50% particle size (D50) based on the volume distribution was 38.2 μm.

<Production Example of Two-Component Developer 1>

The toner 1 and the magnetic carrier were mixed so that the toner 1 became 10 parts with respect to 90 parts of the magnetic carrier, with the use of a V-type blender (V-10 type: Tokuju Corporation), on conditions of 0.5 s' and a rotation time period of 5 minutes, and a two-component developer 1 was prepared.

The obtained two-component developer 1 was subjected to the following evaluation.

[Evaluation of Low-Temperature Fixability]

An altered machine of a color copying machine (trade name: image RUNNER ADVANCE C9075 PRO) manufactured by Canon Inc. was used as an image forming apparatus.

The two-component developer 1 was charged in a developer container of a cyan position, and the image forming apparatus was altered so that an image could be formed in a state in which the fixing device was removed. Then, an unfixed toner image (hereinafter, unfixed image) was formed on evaluation paper. For the evaluation, plain paper GF-C104 (A4, 104 $g/cm^2$) for color copying machines and printers (sold by Canon Marketing Japan Inc.) was used.

In practice, the development conditions were appropriately adjusted so that the amount of the toner of the FFh image to be mounted on the paper became 1.2 $mg/cm^2$, and an unfixed image of 2 cm×10 cm was formed at the position of 3 cm apart from the leading edge of the A4 vertical evaluation paper and of the center of the evaluation paper. The unfixed image was humidity-controlled for 24 hours in a low temperature and low humidity environment (temperature of 15° C./relative humidity of 10%). FFh is a value indicating 256 gradations by a hexadecimal number, where 00h is the first gradation (white background part) of 256 gradations, and FFh is the 256th gradation (solid part) of 256 gradations.

Subsequently, the fixing device was taken out from the full color copying machine image RUNNER ADVANCE C 9075 PRO manufactured by Canon Inc., and a holder for a fixing test was prepared in a low temperature and low humidity environment (temperature of 15° C./relative humidity of 10%) so that a processing speed and temperatures of upper and lower fixing members could be controlled independently. The processing speed was adjusted to 350 mm/sec, and a temperature of an upper belt of the above holder for the fixing test was adjusted every 5° C. in a range of 100° C. to 200° C. In a state in which a temperature of a lower belt was fixed at 100° C., the above humidity-controlled unfixed image was passed. The fixed image which passed through the fixing device was rubbed 5 times by a reciprocation motion of a lens cleaning wiper (Dusper manufactured by Ozu Corporation) to which a load of 4.9 kPa was applied, and a point at which a rate of the density decrease of the image density between times before and after the rubbing reached 10% or lower was defined as a fixing temperature. Based on such a criterion that when the density decrease exceeding 10% occurs, the image is not fixed, the lowest set temperature of the upper belt at which a rate of the image density decrease did not exceed 10% was determined to be a low temperature fixing temperature, and the low-temperature fixability was evaluated according to the following evaluation criteria.

(Evaluation Criteria: Low-Temperature FIxability)

A: lower than 120° C.

B: 120° C. or higher and lower than 130° C.

C: 130° C. or higher and lower than 140° C.

D: 140° C. or higher and lower than 150° C.

E: 150° C. or higher

[Evaluation of Ejected Paper Adhesion]

The ejected paper adhesion was evaluated with the use of a full color copying machine imageRUNNER ADVANCE C 9075 PRO manufactured by Canon Inc.

The test was conducted in a high temperature and high humidity environment (30° C. and 80% RH) which was a severe condition for the ejected paper adhesion.

For evaluation, a continuous printing test was conducted for 1000 sheets on both sides of office planner A4 paper (basis weight of 68 g/m$^2$) with the use of a test chart having a printing ratio of 6%. After that, the development conditions are adjusted so that the amount of the toner of the FFh image to be mounted on the paper becomes 1.2 mg/cm$^2$, with the use of a highly white paper: GF-C209 (A4, basis weight of 209 g/m$^2$, and sold by Canon Marketing Japan Co., Ltd.), as a thick paper. The fixing temperature is set at 180° C., the image is continuously printed on both sides of 1000 sheets, the sheets are left on a copy receiving tray part for 1 hour in a state of being stacked, and then a state of the paper which has been peeled are evaluated. Specific evaluation criteria are as follows.

A: ejected paper adhesion does not occur.

B: adhesion between sheets of paper is observed, but a defect is not observed in the image when the sheets are peeled.

C: a defect is observed in the image when the sheets are peeled, but the defect is not at a level which causes a practical problem.

D: a noticeable defect is observed in the image when the sheets are peeled.

[Evaluation of Storage Stability]

A cup made from a resin (100 mL, manufactured by Sanpratec Corporation), into which 5.0 g of a toner sample was charged, was left at rest for 3 days, in a harsh environment (temperature of 50° C./relative humidity of 50%). After that, the cup was moved to a normal temperature and normal humidity environment (temperature of 23° C./relative humidity of 50%), and was left at rest overnight.

As a measuring apparatus, "Powder Tester PT-X" (manufactured by Hosokawa Micron Co., Ltd.) was used, and the storage stability was evaluated with the use of a sieve with a mesh opening of 75 μm, in a normal temperature and normal humidity environment (temperature of 23° C./relative humidity of 50%). The amplitude of vibration of the sieve was adjusted so as to become 1.00 mm (peak-to-peak), the toner for evaluation was placed on the sieve, and vibration was applied for 40 seconds. After that, the storage stability was evaluated from the amount of an aggregating product of the toner which remained on the sieve, and the storage stability was evaluated according to the following evaluation criteria.

A: the remaining amount of toner on the mesh is 0.20 g or less.

B: the remaining amount of toner on the mesh exceeds 0.20 g and is 0.40 g or less.

C: the remaining amount of toner on the mesh exceeds 0.40 g.

In each of the above evaluation items, the two-component developer 1 was evaluated all as A.

Examples 2 to 8

(Production Examples of Toners 2 to 8)

Toners 2 to 8 were obtained in the same manner as in the Production Example of toner 1, except that the types and amounts of the binder resin and the plasticizer were changed as shown in Table 2.

(Production Examples of Two-Component Developers 2 to 8)

Two-component developers 2 to 8 were obtained in the same manner as in the Production Example of the two-component developer 1, except that the toners were changed as shown in Table 2. Furthermore, the two-component developers 2 to 8 were evaluated in the same manner as the two-component developer 1. The evaluation results are shown in Table 3.

TABLE 2

| | Two- | | Binder resin | | Plasticizer | | | | |
|---|---|---|---|---|---|---|---|---|---|
| Example No. | component developer No. | Toner No. | Binder resin No | Number of copies | Name | Melting point (° C.) | Number of copies | Tg1 (° C.) | Tg2 (° C.) |
| 1 | 1 | 1 | Binder resin 1 | 81 | 1,2,3-trimethylimidazolium methylsulfate | 113 | 9 | 49 | 60 |
| 2 | 2 | 2 | Binder resin 1 | 81 | tetrabutylammonium methanesulfonate | 80 | 9 | 49 | 60 |
| 3 | 3 | 3 | Binder resin 2 | 75 | tetrahexylammonium tetrafluoroborate | 90 | 15 | 51 | 65 |
| 4 | 4 | 4 | Binder resin 3 | 87 | tetrahexylammonium tetrafluoroborate | 90 | 3 | 52 | 57 |
| 5 | 5 | 5 | Binder resin 1 | 88 | 1-ethyl-3-methylimidazolium hexafluorophosphate | 62 | 2 | 53 | 57 |
| 6 | 6 | 6 | Binder resin 1 | 88 | 1-benzyl-3-methylimidazolium hexafluorophosphate | 136 | 2 | 53 | 57 |
| 7 | 7 | 7 | Binder resin 1 | 70 | 1-butyl-4-methylpyridinium chloride | 158 | 20 | 45 | 55 |
| 8 | 8 | 8 | Binder resin 1 | 70 | 1-butyl-4-methylpyridinium hexafluorophosphate | 158 | 20 | 40 | 55 |

TABLE 3

| Example No. | Comprehensive evaluation | Low-temperature fixability | Ejected paper adhesion | Storage stability |
|---|---|---|---|---|
| 1 | A | A | A | A |
| 2 | A | A | A | A |
| 3 | B | B | A | A |
| 4 | B | B | B | A |
| 5 | C | C | B | A |
| 6 | C | C | B | A |
| 7 | C | A | C | B |
| 8 | C | A | C | C |

In Table 3, the comprehensive evaluation means a level good for ranks of the low-temperature fixability and the ejected paper adhesion, and indicates the rank of compatibility between the low-temperature fixability and the ejected paper adhesion.

[Comparative Examples 1 to 4]

(Production Examples of Toners 9 to 12)

Toners 9 to 12 were obtained in the same manner as in the Production Example of the toner 1, except that the types and amounts of the binder resins and the plasticizers were changed as shown in Table 4.

(Production Examples of Two-Component Developers 9 to 12)

Two-component developers 9 to 12 were obtained in the same manner as in the Production Example of the two-component developer 1, except that the toners were changed as shown in Table 4. Furthermore, the two-component developers 9 to 12 were evaluated in the same manner as the two-component developer 1. The evaluation results are shown in Table 5.

TABLE 4

| | | | Binder resin | | Plasticizer | | | | |
|---|---|---|---|---|---|---|---|---|---|
| Comparative Example No. | Developer No. | Toner No. | Binder resin No. | Number of copies | Name | Melting point (° C.) | Number of copies | Tg1 (° C.) | Tg2 (° C.) |
| 1 | 9 | 9 | Binder resin 4 | 81 | Hydrocarbon WAX | 70 | 5 | 55 | 55 |
| 2 | 10 | 10 | Binder resin 4 | 81 | — | — | — | 55 | 55 |
| 3 | 11 | 11 | Binder resin 4 | 75 | Crystalline polyester 1 | 75 | 5 | 45 | 42 |
| 4 | 12 | 12 | Binder resin 5 | 87 | 1,2,3-trimethylimidazolium methylsulfate | 113 | 7 | 55 | 55 |

TABLE 5

| Comparative Example No. | Comprehensive evaluation | Low-temperature fixability | Ejected paper adhesion | Storage stability |
|---|---|---|---|---|
| 1 | D | D | C | A |
| 2 | D | D | C | A |
| 3 | D | A | D | B |
| 4 | D | D | C | A |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-232102, filed Dec. 12, 2018, which is hereby incorporated by reference herein in its entirety.

What is claimed is:

1. A toner, comprising:

a toner particle comprising a binder resin, an aliphatic hydrocarbon-based wax as a solo wax and a plasticizer;

the binder resin being a polyester resin; and the plasticizer consisting of at least one of an imidazolium salt and an ammonium salt, wherein when steps (i) to (iii) are performed in DSC measurement using the toner as a sample (i) the temperature of the toner is raised for a first time at a rate of 10° C./min, (ii) after step (i), the temperature of the toner is lowered at a rate of 10° C./min, (iii) after step (ii), the temperature of the toner is raised for a second time at a rate of 10° C./min, Tg1 is 53° C. or lower and Tg2 is 55° C. or higher, when Tg1 represents a glass transition temperature measured at step (i), and Tg2 represents a glass transition temperature measured at step (iii).

2. The toner according to claim 1, wherein Tg1 is 40° C. or higher.

3. The toner according to claim 1, wherein Tg2 is 70° C. or lower.

4. The toner according to claim 1, wherein the plasticizer has a melting point of 60 to 150° C.

5. The toner according to claim 1, wherein the plasticizer is represented by formula (1)

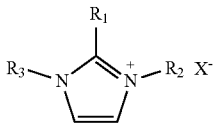

(1)

where $R_1$ represents hydrogen or a methyl group, $R_2$ and $R_3$ independently represent an alkyl group having 1 to 4 carbon atoms or a benzyl group, and $X^-$ represents a counter anion.

6. The toner according to claim 1, wherein the plasticizer is represented by formula (2)

(2)

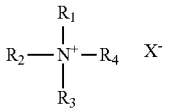

where $R_1$ to $R_4$ independently represent an alkyl group having 4 to 6 carbon atoms, and $X^-$ represents a counter anion.

7. The toner according to claim 1, comprising 3 to 15% by mass of the plasticizer.

8. A toner, comprising:

a toner particle comprising a binder resin and a plasticizer;

the binder resin being a polyester resin; and the plasticizer comprising an imidazolium salt or an ammonium salt, wherein when steps (i) to (iii) are performed in DSC measurement using the toner as a sample (i) the temperature of the toner is raised for a first time at a rate of 10° C./min, (ii) after step (i), the temperature of the toner is lowered at a rate of 10° C./min, (iii) after step (ii), the temperature of the toner is raised for a second time at a rate of 10° C./min, the binder resin and the imidazolium salt or the ammonium salt dissolve each other whereby Tg1 is 53° C. or lower, when Tg1 represents a glass transition temperature measured at step (i), and the binder resin and the imidazolium salt or the ammonium salt cause phase separation whereby Tg2 is 55° C. or higher, when Tg2 represents a glass transition temperature measured at step (iii).

* * * * *